US010364476B2

(12) United States Patent
Smukala et al.

(10) Patent No.: US 10,364,476 B2
(45) Date of Patent: Jul. 30, 2019

(54) METHOD AND DEVICE FOR PRODUCING A PRESS-QUENCHED PART

(71) Applicants: ThyssenKrupp Steel Europe AG, Duisburg (DE); ThyssenKrupp AG, Essen (DE)

(72) Inventors: Volker Smukala, Bochum (DE); Ralf Sünkel, Ratingen (DE)

(73) Assignee: ThyssenKrupp AG, Essen (DE)

( * ) Notice: Subject to any disclaimer, the term of this patent is extended or adjusted under 35 U.S.C. 154(b) by 347 days.

(21) Appl. No.: 15/325,714

(22) PCT Filed: Jun. 26, 2015

(86) PCT No.: PCT/EP2015/064542
§ 371 (c)(1),
(2) Date: Jan. 11, 2017

(87) PCT Pub. No.: WO2016/005210
PCT Pub. Date: Jan. 14, 2016

(65) Prior Publication Data

US 2017/0226603 A1 Aug. 10, 2017

(30) Foreign Application Priority Data

Jul. 11, 2014 (DE) ..... 10 2014 109 773

(51) Int. Cl.
*B21D 19/08* (2006.01)
*B21D 22/02* (2006.01)
(Continued)

(52) U.S. Cl.
CPC ..... *C21D 1/673* (2013.01); *B21D 19/088* (2013.01); *B21D 22/022* (2013.01); *B21D 37/16* (2013.01); *C21D 9/34* (2013.01)

(58) Field of Classification Search
None
See application file for complete search history.

(56) References Cited

U.S. PATENT DOCUMENTS

2003/0066581 A1 4/2003 Gehringhoff et al.
2008/0196800 A1* 8/2008 Beenken ..... B21D 22/022 148/643

FOREIGN PATENT DOCUMENTS

CN 2587545 Y 11/2003
CN 201157870 A 12/2008
(Continued)

OTHER PUBLICATIONS

German Language International Search Report for PCT/EP2015/064542, dated Sep. 8, 2015.
(Continued)

*Primary Examiner* — Colin W. Slifka
(74) *Attorney, Agent, or Firm* — RMCK Law Group PLC

(57) ABSTRACT

A method and device for producing a press-quenched part having a rim hole with a collar formed at the periphery of the rim hole includes inserting a temperature-controlled die into the rim hole of the part. The temperature of the temperature-controlled die is controlled such that the temperature of the part in a region of the collar is held above the martensite start temperature of the material from which the part is made. While the temperature of the collar is being held above the martensite start temperature, the remainder of the part is press quenched.

6 Claims, 1 Drawing Sheet

(51) Int. Cl.

| | |
|---|---|
| ***B21D 37/16*** | (2006.01) |
| ***C21D 1/673*** | (2006.01) |
| ***C21D 9/34*** | (2006.01) |

(56) References Cited

FOREIGN PATENT DOCUMENTS

| | | | |
|---|---|---|---|
| CN | 101987333 | A | 3/2011 |
| CN | 103381440 | A | 11/2011 |
| CN | 103382518 | A | 11/2013 |
| DE | 10149220 | C1 | 8/2002 |
| DE | 102011117066 | A1 | 5/2013 |
| EP | 1253208 | A1 | 10/2002 |
| FR | 2889466 | A1 | 2/2007 |
| FR | 2996473 | A1 | 4/2014 |
| GB | 2313848 | A | 12/1997 |

OTHER PUBLICATIONS

English Translation of International Search Report for PCT/EP2015/064542, dated Sep. 8, 2015.
German Language the Written Opinion of the International Searching Authority for PCT/EP2015/064542.
English Translation of the Written Opinion of the International Searching Authority for PCT/EP2015/064542.
English translation of Abstract of EP 1253208 A1.
English translation of Abstract of EP 102011117066 A1.
English translation of Abstract of FR 2996473 A1.
English translation of Abstract of FR 2889466 A1.
English language Abstract for CN 2587545 Y listed above.
English language Abstract for CN 103382518 A listed above.
English language Abstract for CN 101987333 A listed above.
English language Abstract for CN 103381440 A listed above.
English language Abstract for CN 201157870 Y listed above.

* cited by examiner

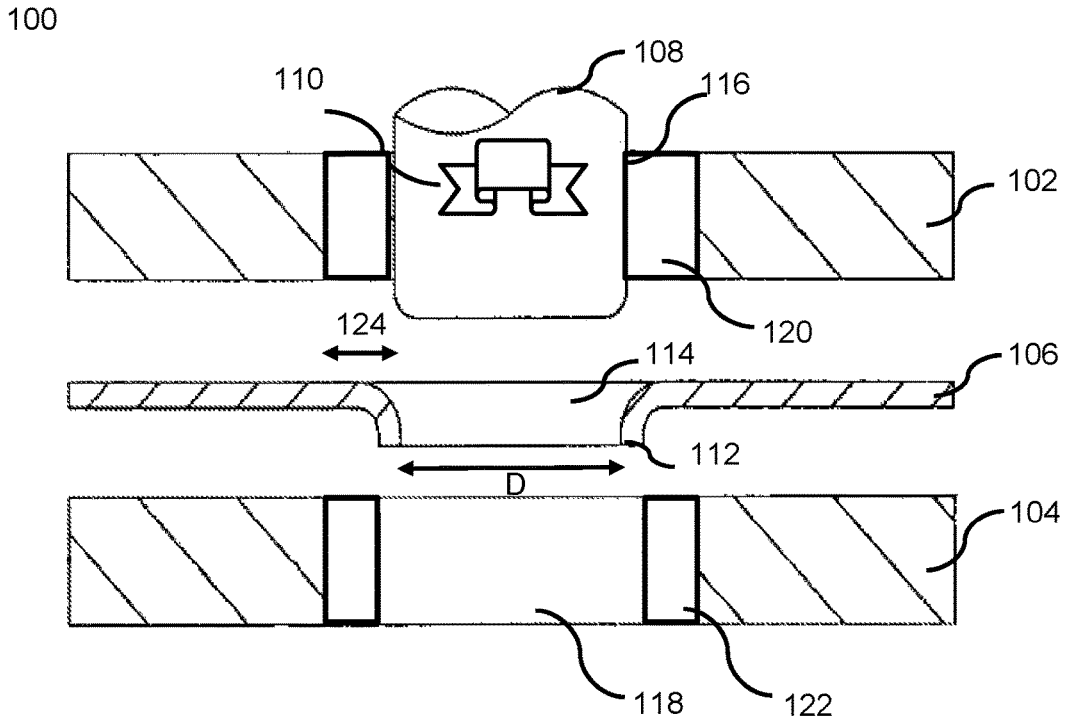
100
108
110
116
102
120
124
114
106
112
D
104
118
122

METHOD AND DEVICE FOR PRODUCING A PRESS-QUENCHED PART

CROSS REFERENCE TO RELATED APPLICATIONS

This application is a U.S. National Stage Entry of International Patent Application Serial Number PCT/EP2015/064542, filed Jun. 26, 2015, which claims priority to German Patent Application No. DE 102014109773.4 filed Jul. 11, 2014, the entire contents of both of which are incorporated herein by reference.

FIELD

The present invention relates to a method for producing a press-quenched part having a collar.

BACKGROUND

Due to their high strength characteristics, hot-formed and press-quenched parts are used as safety-relevant parts for example in automotive construction. Rim holes and/or collars of parts that are accommodated in other part elements, in particular chassis parts, can be subject to repeated alternating loads. In the case of rim holes having a high degree of hardness, there is an increased likelihood of such permanent repeated loads leading to premature material wear of the parts in the region of the rim holes and/or collars since hard materials have very low ductility and stress peaks cannot be absorbed by elastic deformation. In the case of parts having the same material hardness in the region of the rim holes and/or collars as in other regions of the part, there is therefore an increased risk of breakage. Since in the prior art for example such rim holes with a collar serve as connection interfaces between different vehicle parts, the vehicle safety is very high due to the resulting risk that vehicle parts can come loose from one another or fail suddenly.

Press-quenching methods for creating quenched sheet metal profiles having a rim hole with a projecting collar by inserting a cooled die into a region of the part are known from the prior art, with the intention of achieving a homogeneously high material hardness in the entire part (DE 101 49 220 C1).

BRIEF DESCRIPTION OF THE DRAWINGS

The present disclosure is described in detail below with reference to the attached drawing FIGURES, wherein:

FIG. 1 is a schematic side cross section view of a device for press-quenching a part, as disclosed herein.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

The present invention has the object of providing a method for producing a press-quenched part having a rim hole with a projecting collar, whereby the rim hole with projecting collar obtains greater resistance to repeated loading due to vibrations and/or stress peaks.

The object of the present invention is achieved with a method for producing a press-quenched part which comprises a rim hole having a collar formed at the periphery of the rim hole, characterized in that prior to or during press-quenching of the part a temperature-controlled die is inserted into the rim hole, wherein the temperature of the temperature-controlled die is controlled such that the temperature in the region of the collar is held above the martensite start temperature of the steel material used.

In that context, the method according to the invention for producing a press-quenched part has the advantage over the prior art of first preventing the structure in the region of the rim hole or the collar converting to martensite during press-quenching. While increasing contact pressure from the pressing tool is associated with increased hardness in the remaining material due to incipient phase transition to martensite, martensite formation is prevented in the region of the rim hole or of the collar. Instead, a soft mixed structure is formed in the region of the rim hole or of the collar. Controlling the temperature of the die inserted into the rim hole largely prevents abrupt cooling, thus establishing lower material strength and higher ductility in comparison to the remaining region. The material in the region of the rim hole or of the collar thus has a greater elongation at break. Vibration energy or stress energy absorbed at the rim hole or at the collar can be partially converted into elastic deformation energy, thus lowering the risk of breakage at the connection interfaces of multiple components. The behavior exhibited by the parts in the region of the rim holes or of the collars under repeated alternating loads in compression and in contact improves. Also, the likelihood of an edge crack forming when drawing the collar is reduced. The welding properties of the collars which may serve as connection interfaces also improve.

In another embodiment, it is provided that the temperature-controlled die that is inserted during press-quenching of the part remains in the rim hole during the entire press-quenching process.

An advantageous consequence of this is that, during the entire production process, the temperature of the die is regulated so as not to drop below a start temperature for transition to martensite in the region of the rim hole or of the collar, even if the temperature drops further in the remaining region. Also, keeping the temperature constantly above a certain temperature has a positive influence on the collar forming process in that the collar crack sensitivity reduces. Advantageously, it is possible to draw the collar by punching the die through the part that is to be pressed, without the collar cracking during the material drawing process. The part that is to be press-quenched may equally be produced in a one-stage process, a two-stage process or a multi-stage process that is preceded by at least one forming, in particular of the rim hole, in the cold state. Depending on the composition of the steel, the temperature of the die can for example be at least 400° C., in particular at least 450° C. and does not exceed the Ac1 temperature, that is to say is preferably not higher than 700° C.

In another embodiment, the remaining portion of the part is actively cooled during press-quenching.

The higher cooling rates, in particular with increasing contact pressure in the remaining portion of the part that is to be quenched, have the advantageous effect that the material hardness in the material increases due to the transition to martensite in the material structure. In that portion in which the part that is to be quenched is not subject to the repeated loading of vibration of adjacent components, the part can be given maximum hardness. Preferably, a region encircling the rim hole is also not fully hardened, it being thus possible to set a constant and for example not abrupt transition between the fully hardened region and the lower-strength region. The encircling region is for example at most twice and preferably at most 1.5 times the diameter of the rim hole.

According to another embodiment, it is provided that a top tool of the press-quenching tool is designed to accommodate the temperature-controlled die in an extendable and form-fitting manner in a first opening.

The form-fitting installation of the die that can be extended from the first opening in the direction of the material that is to be quenched ensures high-stability guiding of the movement of the die, such that the collar can be drawn under conditions that are stable and can be calibrated. An extended position of the temperature-controlled die also means that transition to martensite is prevented only in the region of the rim hole or of the collar, but not in the remaining portion of the part. The localized reduction in material hardness can thus take place in a selective manner. As an alternative to the extendable die, the die and top tool can be formed as one unit, as a result of which the construction can be simpler and at least the drive apparatus for the die can be dispensed with.

In another embodiment, a bottom tool of the press-quenching tool is designed to accommodate the extended temperature-controlled die and the collar in a form fitting manner in a second opening, wherein the second opening is opposite the first opening and has a larger radius or diameter than the first opening.

This advantageously substantially increases the accuracy of the motion guiding for the temperature-controlled die, and makes it possible in the first place to draw the collar in the direction of the bottom tool, since, during pressing, a deflection space is made available for that material which is pushed out of the plane of the material that is to be quenched.

In another embodiment, it is provided that the geometry of the temperature-controlled die determines the geometry of the rim hole, and the degree of extension of the temperature-controlled die determines a height of the collar.

By choosing the dimensions of the temperature-controlled die and the degree to which the temperature-controlled die punches through the rim hole with a certain degree of extension, it is advantageously possible to determine the shape of a collar of a part that is to be quenched. It is easy to adapt to given spatial or static-dynamic conditions.

The present invention also relates to a device for producing a press-quenched part which comprises a rim hole having a collar formed at the periphery of the rim hole, wherein a press-quenching tool is used to produce the press-quenched part, characterized in that the device also has a temperature-controlled die that is designed to be inserted into the rim hole prior to or during press-quenching of the part, where it is to be temperature-controlled such that the temperature in the region of the collar is held above the martensite start temperature of the steel material used.

Further details, features and advantages of the invention can be found from the drawing and from the following description of preferred embodiments, with reference to the drawing. In this context, the drawing merely illustrates advantageous embodiments of the invention, which do not restrict the essential inventive concept.

FIG. 1 shows, schematically, a device 100 for hot forming, in particular for press-quenching, a part 106. The device consists of a top tool 102 and a bottom tool 104, between which is arranged the part 106 that is to be shaped during the hot forming process, in particular press-quenching. The part 106 that is to be shaped can be introduced into the device 100 as a planar, pre-perforated sheet metal cutout in the hot state (single-stage hot forming) or as an already cold, pre-shaped semi-finished product (two-stage hot forming) in the hot state.

A die 108 is installed in a first opening 116 of the top tool 102. The die 106 has means 110 for controlling the temperature of the die 106. The bottom tool 104 has a second opening 118 for receiving both the die 108 and a drawn collar 112 of the part 106. It is thus necessary for the second opening 118 to have a greater radius or diameter than the first opening 116.

Another prerequisite for collar drawing is a first opening 116 in the part 106, through which the temperature-controlled die 108 can be driven prior to or during the hot forming process. The rim hole 114 can be introduced, prior to hot forming, into the still-cold shaped plate of the part 106 or by means of a hot step immediately prior to collar drawing in the hot forming tool 100.

In a shaping step, the geometry of the rim hole 114 and of the collar 112 of the part 106 are drawn and/or calibrated, by means of the extending temperature-controlled die 108, into the hot part 106 that is to be press-quenched. Alternatively, the top tool and the die are designed as one unit. In that portion of the part 106 in which the maximum material hardness is to be achieved by transition to martensite, the pressing tool 100 is cooled conventionally, for example by active cooling or by tool mass.

The inventive method for producing break-resistant collars of a press-quenched part is characterized in that the die 108 that is inserted into the part prior to or during the hot forming process is temperature-controlled during the entire shaping process such that no martensite formation takes place in the region of the collar, with the result that there forms, here locally, a soft mixed structure having greater elongation at break and greater ductility, while the remaining region of the part 106 is given maximum hardness by high cooling rates. The collar-drawing die 108 remains in the rim hole 114 during the entire hardening process and is actively temperature-controlled by the temperature-control means 110. By means of constant, suitable temperature control of the die 108, the temperature in the part 106, in the local region of the collar 112, always remains above the martensite start temperature, thus making it possible to have a localized region of high ductility and elongation at break, and collar drawing without edge cracks. Preferably, a region 124 encircling the rim hole 114 is not fully hardened, in order to create a continuous transition between the fully hardened region and the lower-strength region. The encircling region 124 is for example at most twice and preferably at most 1.5 times the diameter D of the rim hole. This region 124 can be set by the means 120, 122 integrated into the top and bottom tools 102, 104. The means 120, 122 may be temperature-controlled or be made of a material having poor thermal conductivity, for example a ceramic. Preferably, at least the means 120 has insulation for thermal separation between the temperature-controlled die 108 and the preferably actively cooled top tool 102.

The locally different material hardness can effectively counteract material wear phenomena that are caused by repeated alternating loads from other attached parts, or stress peaks caused by assembling different parts. The service life of connected parts can be significantly extended and the safety for example of a multi-component vehicle chassis can be substantially increased.

What is claimed is:

1. A method for producing a press-quenched part having a rim hole with a collar formed at a periphery of the rim hole, the method comprising:

providing a part to be press-quenched, having a rim hole with a collar formed at the periphery of the rim hole;

inserting a temperature-controlled die into the rim hole of the part;

controlling the temperature of the temperature-controlled die such that the temperature of the part in a region of the collar is held above a martensite start temperature of a material from which the part is made;

press-quenching the part either during or after said inserting and controlling steps.

2. The method of claim 1, further comprising maintaining the insertion of the temperature-controlled die in the rim hole during the entire press quenching step.

3. The method of claim 1, further comprising cooling a remaining portion of the part, except for the collar, during the press quenching step.

4. The method of claim 1, wherein said press quenching step is performed by a press-quenching tool having a top tool with a first opening defined therein that is configured to permit the temperature-controlled die to extend there through in a form fitting manner.

5. The method of claim 4, wherein said press quenching step is performed by a press-quenching tool having a bottom tool with a second opening defined therein that is coaxial with the first opening defined in the top tool, and which second opening has a larger diameter than the first opening, the bottom tool configured to permit the temperature-controlled die to extend there through in a form fitting manner.

6. The method of claim 1, wherein a specific geometry of the rim hole and a height of the collar that is formed is determined by a geometry of the temperature-controlled die and the amount of extension of the temperature-controlled die into the rim hole, during said step of inserting the temperature-controlled die into the rim hole.

* * * * *